US006302736B1

(12) United States Patent
Nishio et al.

(10) Patent No.: US 6,302,736 B1
(45) Date of Patent: Oct. 16, 2001

(54) MINIATURE CONNECTOR

(75) Inventors: Atsushi Nishio, Ibaraki; Katsuhiro Hori, Mito, both of (JP)

(73) Assignee: Mitsumi Electric Co., Ltd. (JP)

( * ) Notice: Subject to any disclaimer, the term of this patent is extended or adjusted under 35 U.S.C. 154(b) by 0 days.

(21) Appl. No.: 09/511,458

(22) Filed: Feb. 23, 2000

(30) Foreign Application Priority Data

Feb. 26, 1999 (JP) ..... 11-049246

(51) Int. Cl.[7] ..... H01R 13/40

(52) U.S. Cl. ..... 439/596; 439/404

(58) Field of Search ..... 439/406, 608, 439/404, 405, 610, 596, 703, 589

(56) References Cited

U.S. PATENT DOCUMENTS 5,147,222 * 9/1992 Hotea et al. ..... 439/589

* cited by examiner

*Primary Examiner*—Paula Bradley
*Assistant Examiner*—James R. Harvey
(74) *Attorney, Agent, or Firm*—Morrison Law Firm

(57) ABSTRACT

A miniature connector has an inner insulating body, which supports a plurality of contact conductors which contact other contact conductors on the companion connector, the inner insulating body being surrounded on the outside by a shield case, and an external insulated mold covering an outer surface of a connection cord side end of the shield case, wherein: a flap is formed in a unitary manner via a thin-walled hinge on the internal insulating body; a plurality of plug protrusions are formed on the internal insulating body; resin leakage during formation of the external insulated mold being prevented by inserting each of the plug protrusions into contact conductor passage holes.

7 Claims, 4 Drawing Sheets

MINIATURE CONNECTOR

BACKGROUND OF THE INVENTION

The present invention relates to an electrical connector. In particular, the present invention relates to a miniature connector used in connecting electronic devices such as personal computers and the like.

Because of component crowding in small space areas in these electronic devices, the USB type connectors employed are quite small and commonly are termed as such or as "miniature" connectors.

As is well known, in a connector plug, which is used to connect to a connector socket mounted, e.g., on a printed circuit board, a shield case covers the outside of an inner insulated body, which supports a plurality of contacters. The exterior surface of the end part on the connection cord side of this shield case is covered with an external insulated mold.

However, when molding this external insulated mold, the injection pressure of the molding resin can reach several 10's of kg/cm2. As a result, the external insulated mold resin can enter into the interior of the shield case from spaces in the shield case, which is positioned on the injection molding die and this can create problems.

In the inner insulated body in the interior of the connector plug, a plurality of contacter housing holes, in which contact conductors (contacters) are inserted and supported, are formed. When the external insulating resin enters into a part of these contacter housing holes, the surface of the contacter can become coated with resin. In connector use, this can cause contact failure.

As a result, in the manufacturing process for the connector plug with the construction described above, prior to the molding of the external insulated mold, the entrance to the contacter housing holes is covered with seal tape or by a separate part, such as a plug to prevent the flow of mold resin into the contacter housing holes.

However, with this method of closing the contacter housing holes, the work requires precision, and forceps for handling very small parts must be used. As a result, work efficiency is poor, and the work requires skilled labor.

OBJECT AND SUMMARY OF THE PRESENT INVENTION

The object of the present invention is to provide a miniature connector with a construction that does not require a special plug or a tape seal to close the contacter housing holes prior to forming the external insulated mold.

In order to achieve this objective, the present invention provides a miniature connector having an inner insulating body, which supports a plurality of contact conductors which contact conductors on a companion connector, the inner insulating body being surrounded on the outside by a shield case, and an external insulated mold covering an outer surface of a connection cord side end of the shield case, wherein: a flap is formed in a unitary manner via a thin-walled hinge on the internal insulating body; and a plurality of plug protrusions are formed on the insulating body in a protruding manner so that the flap can be manipulated or folded to insert each of the plug protrusions into the contacter housing holes or passages in a hole or passage blocking position thereby to block resin leakage into same during formation of the external insulated mold.

In the detailed description of preferred embodiments of the present invention given later, the following features will be explained:

1) a construction, wherein: a means for locking, which maintains the plug protrusions in an inserted state with respect to the contact conductor housing or passage holes, is formed between a main body part of the inner insulating body and the flap.

2) a construction, wherein: the means for locking has a pair of locking tabs formed in unitary manner on both ends of either the main body part or the flap, and, strikers formed in unitary manner opposite the locking tabs on both ends of a other of the main body or the flap.

3) a construction, wherein: a connecting part cover, which covers the contact conductor at an end part that is soldered to a connection cord, is formed in unitary manner on the flap; a soldering part of the connection cord is protected by the connecting part cover.

4) a construction, wherein: the miniature connector is a connector plug, which is inserted into an insertion opening of a companion connector socket which is mounted on a printed circuit board.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
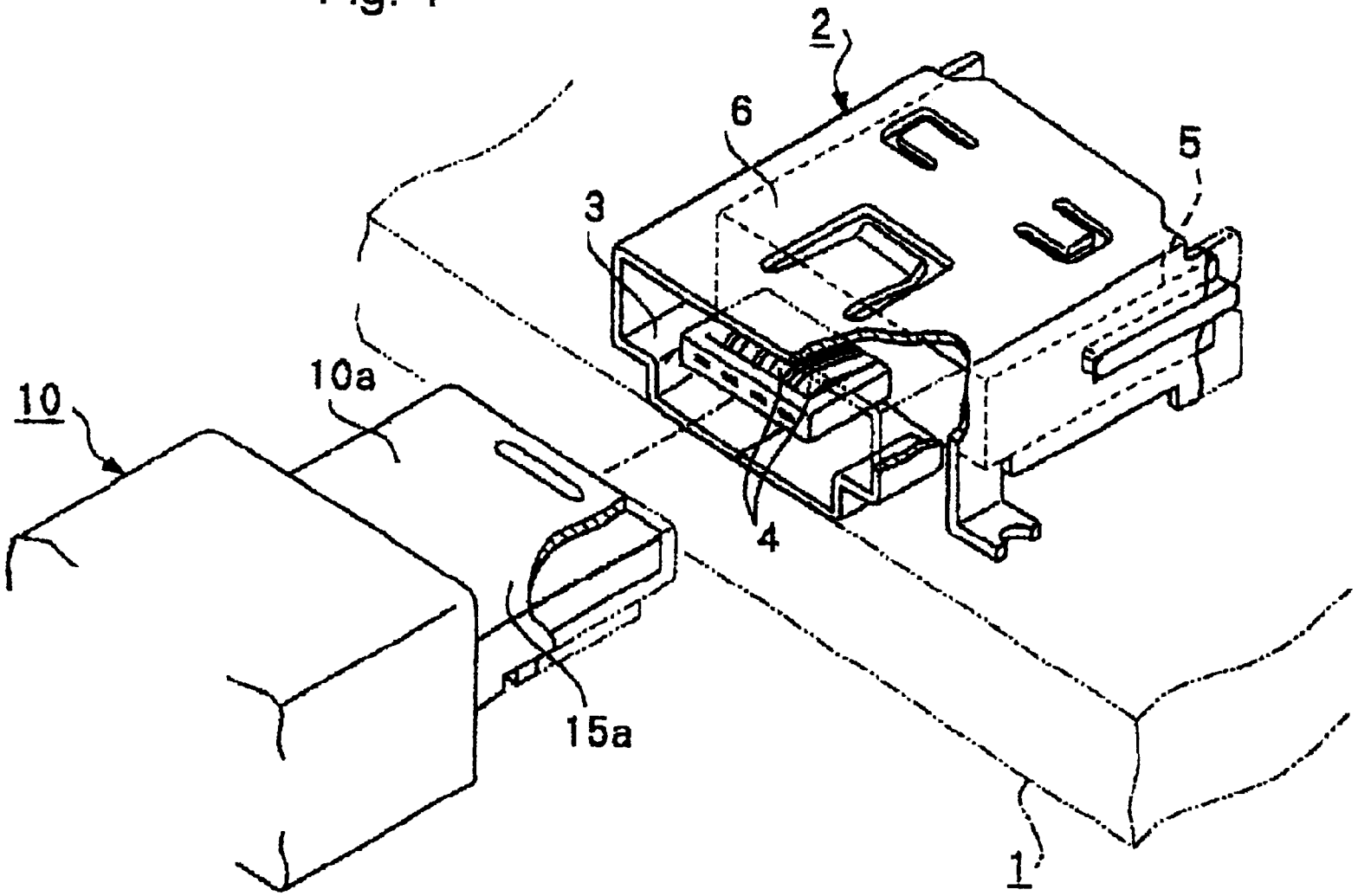
FIG. 1 is a perspective view of a miniature connector of the present invention with a section removed.
Figure 2:
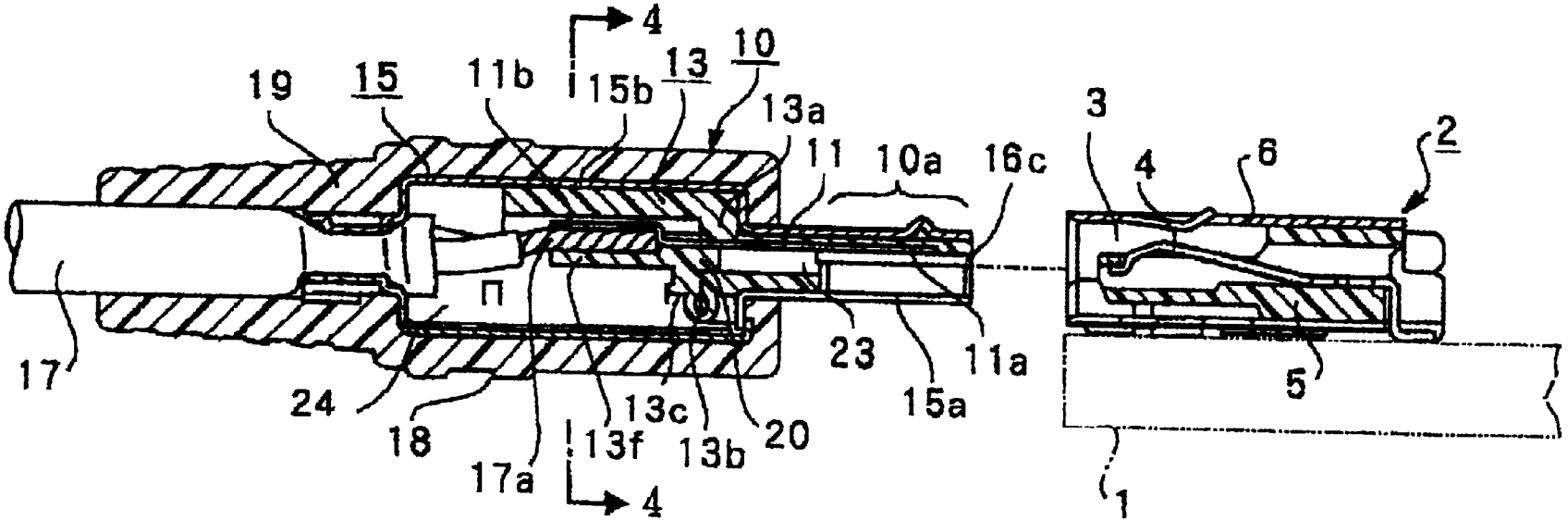
FIG. 2 is an entire cross-section of the same miniature connector.

Referring to FIGS. 1 and 2, a plug part 10*a* of a connector plug 10 is detachably insertable in an insertion opening 3 of a connector socket 2, on a printed circuit board 1.

Connector socket 2 includes an insulated mold 5, which supports a plurality of contacts 4 aligned in the cross direction. Insulated mold 5 is housed in metal shield case 6 of rectangular tubular configuration. Insulated mold 5 is shielded from external electric fields and external magnetic fields by shield case 6.

Connector plug 10 has an inner insulated body 13 supporting a plurality of contacters 11 (contact conductors) which are aligned spaced in parallel with each other and extending longitudinally perpendicular to the viewing direction in Figure. Internal insulating body 13 is surrounded by a shield case 15 of metal plate bent and formed into rectangular tubular configuration.

Internal insulated body 13, which is an injection molded component, includes a plurality of contacter housing grooves 16A, 16B (FIGS. 3 and 4) which are on cord connecting part side of the connector plug and extend in the longitudinal direction of internal insulating body 13, a contact passage hole 23, and main body part 13*a*. The inside of body part 13 has a contact housing groove 16C on the component plug part side. Contacters 11 are each positioned inside contacter housing grooves 16A, 16B, contact passage hole 23, and plug part side contact housing groove 16C. However, when a contacter 11 is inserted into contacter housing grooves 16A, 16B, a contact end part 11*a* and a connecting end part 11*b* are exposed in housing grooves 16A, 16B and in contact housing groove 16C in order to have elastic contact with contact 4 and also to have soldered to core wire 17*a* of connection cord 17.

Shield case 15 has a plug part shield 15*a* of the same cross-sectional shape as insertion opening 3 of connector socket 2. A cord connecting part 15*b* of the plug part shield has an enlarged cross-sectional shape formed continuous with plug part shield 15*a*. An after part of housing inner insulating body 13 and an end of connection cord 17 are closed by a shield cover 18.

Furthermore, in the manufacture process for connector plug 10, after putting together shield case 15, inner insulating body 13, and connection cord 17, these are placed in an injection molding die, and external insulated mold 19 is molded onto the outer surface of everything except plug part shield 15*a*.

Figure 3:
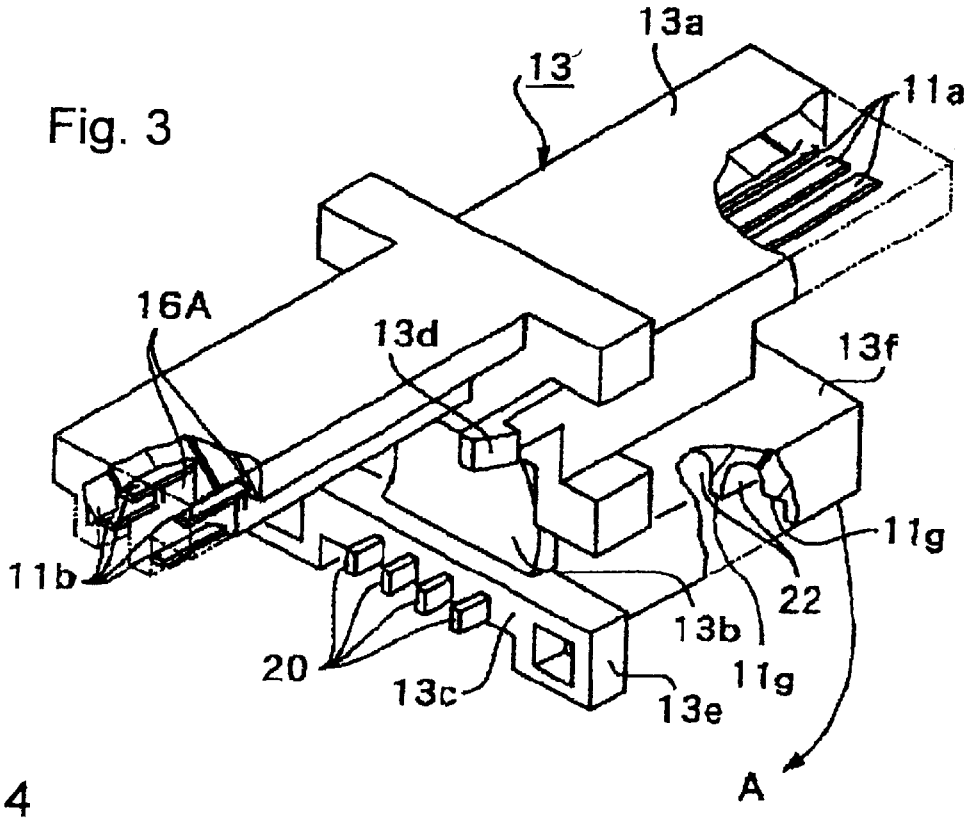
FIG. 3 is an enlarged perspective view of the inner insulated body of the same miniature connector with a section removed.
Figure 4:
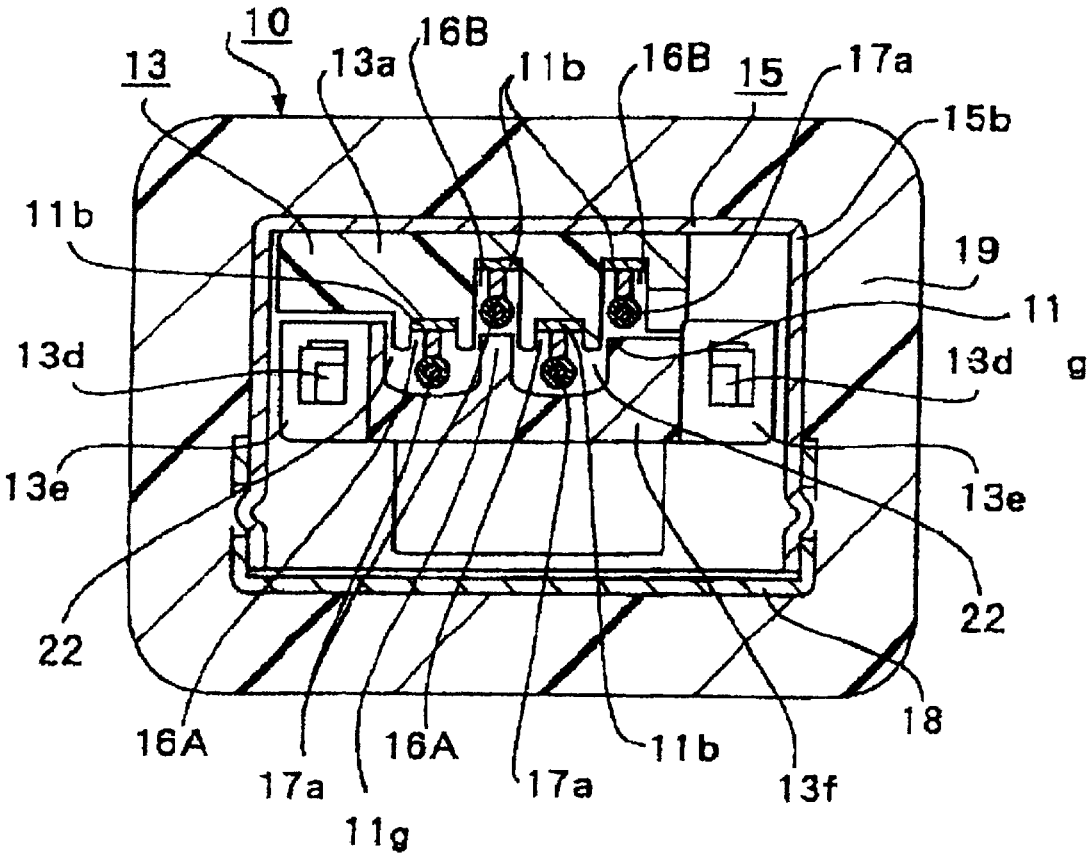
FIG. 4 is an enlarged cross-section of FIG. 2 along line 4—4.

Referring to FIGS. 3 and 4, the details of inner insulating body 13, which is injection molded, are shown. Contacter housing grooves 16A, 16B are formed in main body 13*a* of inner insulating body 13. Referring to FIG. 4, adjacent contacter housing grooves 16A, 16B in the alignment direction have alternately differing depths. As a result, when connecting end parts 11*b* of contacters 11 are installed into contacter housing grooves 16A, 16B, connecting end parts 11*b* are arranged in a zigzag manner.

Therefore, in contacter housing grooves 16A, 16B, core wires 17*a*, which are soldered onto connecting end parts 11*b* of contacters 11, are also arranged in a zigzag manner.

Figure 6:
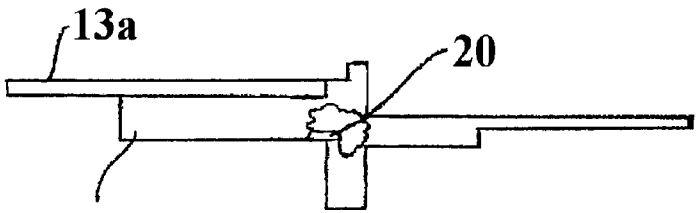
FIG. 6 is a view of the FIG. 5 structure with the flap in final position, part of the structure being broken away to illustrate the inserted blocking position of the protrusions.
Figure 5:
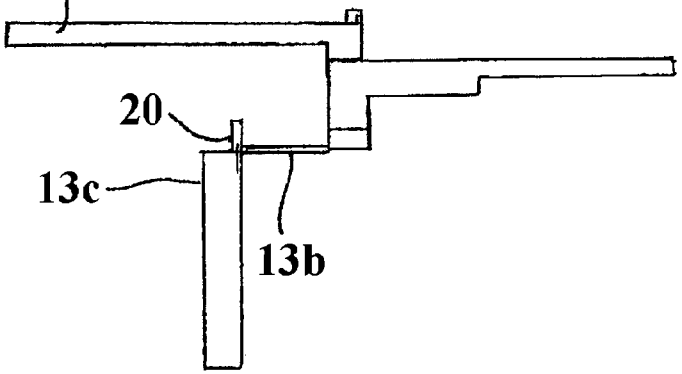
FIG. 5 is a diagrammatic side elevational view on enlarged scale with portions shown in section of the inner insulating body depicting the flap at an intermediate position thereof in the course of swinging from an initial position to a final position wherein the protrusions thereof enter and block the housing holes.

Referring to FIG. 3, a flap 13*c*, which can be bent or swung via a thin-walled hinge 13*b* in the direction A, is formed in unitary manner on the lower part of main body 13*a* of inner insulating body 13. The flap carries a plurality of small plug protrusions 20, which on swinging the flap from the FIG. 3 and 5 positions to the FIGS. 2 and 6 positions each become inserted into contacter housing or passage holes 23. Protrusions 20 are unitary with the surface of flap 13*c*. By inserting plug protrusions 20 into the corresponding contacter housing or passage holes 23, the holes of contacter passage holes 23 can be closed off by the blocking presence therein of the protrusions.

A pair of locking tabs 13*d*, which are positioned on both ends of thin-walled hinge 13*b*, are formed unitary with the main body part 13*a*. Strikers 13*e* corresponding to locking tabs 13*d*, are provided these being in the form of rectangular open frames at the right and left sides of flap 13*c*.

Flap 13*c* is bent 180 degrees from the FIG. 3 position , and plug protrusions 20 become aligned with and inserted into the corresponding contacter housing or passage holes 23, flap 13*c* being pushed strongly against the middle surface of main body 13*a*. With this action, locking tabs 13*d* also become engaged inside strikers 13*e*, and main body 13*a* and flap 13*c* become securely fastened to each other. Contacter passage holes 23 are completely closed off by plug protrusions 20. The plug protrusions 20 are prevented from inadvertently slipping out of contacter passage holes 23, and block them to prevent resin from external insulated mold 19 forming operation from entering contacter passage holes 23.

The flap structure includes a connecting part cover 13*f*. With flap 13*c* fastened to the main body part 13*a* by locking tabs 13*d*, connecting part cover 13*f* lies on top of the connection part side of main body 13*a*. Wide grooves 22 are formed on the surface of connection cover 13*f*, and positioned opposite contacter housing groove 16A, which is the shallower of the contacter housing grooves 16A, 16B, the wide grooves spanning between adjacent contacter housing grooves 16A, 16B. Core wires 17*a* are soldered onto connecting end part 11*b* in the shallow contacter housing groove 16A are placed in wide grooves 22.

Furthermore, core wires 17*a* that are soldered onto connecting end part 11*b* of deep contacter housing groove 16B are prevented from popping out of their corresponding contacter housing grooves 16B by restraint pieces 11*g* on connection cover 13*f*. Adjacent core wires 17*a*, which are soldered onto connecting end parts 11*b* of contacters 11, are completely separated vertically. Inadvertent contact between core wires 17*a* is prevented in advance.

In making connector plug 10, after contacters 11 are inserted into contacter housing grooves 16A, 16B of inner insulating body 13 and each connecting end part 11*b* is soldered onto core wire 17*a* of connection cord 17, inner insulating body 13 is positioned inside shield case 15. The open part of shield case 15 is covered with shield cover 18. Connector plug 10 is completed by forming an external insulated mold 19 surrounding shield case 15 and shield cover 18. During the mold formation, resin enters by high pressure into connection area 24 inside the shield case cover.

Figure 7:
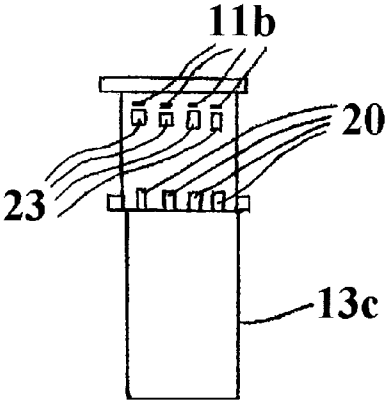
FIG. 7 is a fragmentary left end view of FIG. 5 illustrating the inner body housing holes into which the flap carried protrusions enter and locate nested under the contacters which are disposed in said housing holes.

In the process for attaching contacters 11 into inner insulating body 13, each contacter 11 is passed through contact passage hole 23. After inserting contacters 11 into contacter housing grooves 16A, 16B, 16C, flap 13*c* is swung from thin-walled hinge 13*b* 180 degrees towards main body 13*a* of inner insulating body 13, this change of flap position and effect being understood from reference to FIGS. 5–7. Plug protrusions 20 are inserted into contact passage holes 23 blocking them. By pushing flap 13*c* strongly against main body 13*a*, locking tabs 13*d* fall into strikers 13*e*. Spaces in contact passage holes 23, where there is the risk of having resin from external insulated mold 19 enter, are eliminated.

In addition, when locking tabs 13*d* are fastened to flap 13*c*, the lower surface of main body 13*a* is covered by connecting part cover 13*f*. Core wires 17*a* of connection cord 17, which are soldered onto connecting end part 11*b* in each of contacter housing grooves 16A, 16B, are covered completely by connecting part cover 13*f*. In addition, adjacent connecting end parts 11*b* are positioned in a separated manner in wide grooves 22, which are formed on connecting end cover 13*f*, and in deep contacter housing grooves 16B. As a result, even if the alignment pitch of contacters 11 and contacter housing grooves 16A, 16B is made small, there is no short circuiting of adjacent connecting end parts 11*b* and core wires 17*a*.

Wide grooves 22 are formed on connecting part cover 13*f* and span between contacter housing grooves 16A, 16B which are adjacent in the cross-direction. Wide grooves 22 also house core wires 17*a* that are soldered to contacter 11 of shallow contacter groove 16A. In addition, core wires 17*a* of connection cord 17 which are positioned inside deep contacter housing grooves 16B are prevented from popping out of each deep contacter housing groove 16B by restraint pieces 11*g* of connecting part cover 13*f*. As a result, there is no short circuiting.

While the invention is herein described with respect to connector plug 10, it is obvious that it could be applied to connector socket 2 as well.

After putting together inner insulating body 13, connection cord 17 as described above, they are placed in shield case 15 and closed by shield cover 18. Afterwards, on the outer surface of everything except plug part shield 15*a*, external insulated mold 19 is molded. Because the injection pressure is high pressure, resin enters inside connection area 24 inside shield case 15. However, for contact passage hole 23 and contact housing groove 16C on the plug side, because contact passage holes 23 are closed off by plug protrusions 20, the leaking of the resin is prevented.

As is clear from the above description, by the present invention, a flap is formed in a unitary manner on the internal insulating body, which supports the contacters. Plug protrusions protruding from the flap are inserted into contacter housing grooves, and the spaces formed in the contacter passage holes are eliminated. As a result, resin from the external insulated mold can be prevented in advance from entering into the contacter passage holes.

Because this flap is formed in a unitary fashion on the main body when the inner insulating body is being molded, inconveniences, such as higher manufacturing costs, the need for special tools such as forceps, or dropping and losing the flap, are eliminated.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a connector plug, an inner insulating body, said insulating body including a main body part having a plurality of passages therein, said passages being open at an underside of said insulating body, a corresponding plurality of contact conductors disposed in said passages, each contact conductor having a contact end and an opposite connecting end connected to an associated core wire, the contact end of each contact conductor being engagable with a corresponding conductor carried in a companion connector socket when the connector plug is inserted in said connector socket, said inner insulating body being surrounded on an outside thereof by a shield case, an external insulated resin mold covering an outer surface of a connection side end of said shield case, said insulating body carrying a flap member swingably connected to said main body part at an underside of said main body part, said flap member having protrusion plugs extending from a surface thereof, a swinging of said flap member upwardly to a position against said main body part being effective for inserting said protrusion plugs into said passages in a passage blocking disposition thereby sealing said passages to prevent leakage of any mold resin through the passages to the contact ends of the contacters disposed therein.

2. The connector plug of claim 1 in which the flap member is hinged to the main body part with a hinge integral with said main body part and said flap member.

3. The connector of claim 1 comprising means for locking said flap member against said main body part and correspondingly said protrusion plugs in inserted position in said passages.

4. The connector of claim 3 in which said locking means comprises cooperating elements carried on each of said flap member and said main body part.

5. The connector of claim 4 in which the cooperating elements comprises locking tabs carried on one of said flap member and said main body part, and tab receptive strikers carried on a other of said flap member and said main body part.

6. The connector of claim 5 in which the locking tabs and strikers are made integral with the one of flap member and said main body part on which they are carried.

7. The connector of claim 2 in which the protrusion plugs are carried at and project from an end face of said flap member, said hinge being joined to said flap member at said end face so that when said flap member is swung to a position against said main body part, a main expanse of said flap member covers the connecting end of each contacter where it is connected to its associated core wire.

* * * * *